US008282349B2

(12) United States Patent
Cooper

(10) Patent No.: US 8,282,349 B2
(45) Date of Patent: Oct. 9, 2012

(54) STEAM TURBINE ROTOR AND METHOD OF ASSEMBLING THE SAME

(75) Inventor: Gregory Edward Cooper, Middle Grove, NY (US)

(73) Assignee: General Electric Company, Schenectady, NY (US)

( * ) Notice: Subject to any disclaimer, the term of this patent is extended or adjusted under 35 U.S.C. 154(b) by 976 days.

(21) Appl. No.: 12/044,607

(22) Filed: Mar. 7, 2008

(65) Prior Publication Data

US 2009/0226315 A1 Sep. 10, 2009

(51) Int. Cl.
*F01D 5/06* (2006.01)
*F01D 5/10* (2006.01)

(52) U.S. Cl. ..... 415/216.1; 415/119; 415/229; 416/144

(58) Field of Classification Search ..... 415/216.1, 415/229–231, 111, 119; 416/144, 174; 384/537, 384/542

See application file for complete search history.

(56) References Cited

U.S. PATENT DOCUMENTS

| | | | | |
|---|---|---|---|---|
| 4,566,810 | A | 1/1986 | Yoshioka et al. | |
| 4,842,485 | A * | 6/1989 | Barber | 416/144 |
| 6,224,334 | B1 | 5/2001 | Siga et al. | |
| 6,344,098 | B1 | 2/2002 | Manning et al. | |
| 6,364,634 | B1 * | 4/2002 | Svihla et al. | 417/409 |
| 6,419,453 | B2 | 7/2002 | Fukui et al. | |
| 6,457,937 | B1 * | 10/2002 | Mashey | 415/160 |
| 6,499,946 | B1 | 12/2002 | Yamada et al. | |
| 7,101,144 | B2 | 9/2006 | Haje et al. | |
| 2004/0253102 | A1 | 12/2004 | Imano et al. | |
| 2006/0216145 | A1 | 9/2006 | Arai et al. | |
| 2007/0077146 | A1 | 4/2007 | Suzuki et al. | |
| 2007/0110570 | A1 | 5/2007 | Bracken et al. | |
| 2009/0324323 | A1 * | 12/2009 | Yamashita et al. | 403/16 |

FOREIGN PATENT DOCUMENTS

| | | | |
|---|---|---|---|
| JP | 07-077044 | * | 3/1995 |
| JP | 08-1211-2 | * | 5/1996 |
| JP | 2008-25596 | * | 2/2008 |

OTHER PUBLICATIONS

Abstract of JP08-121102 to Ryutaro, Rotor for Quick Start Steam Turbine, May 14, 1996.*

Ryutaro, Rotor for Quick Start steam Turbine, May 14, 1996, Machine translation of JP8-121102.*

* cited by examiner

*Primary Examiner* — Edward Look
*Assistant Examiner* — Liam McDowell
(74) *Attorney, Agent, or Firm* — Armstrong Teasdale LLP

(57) ABSTRACT

A steam turbine rotor is provided. The rotor includes at least one bearing section coupled axially to a steampath section including at least one end, the at least one end further including a flange and a bore, the flange and the bore configured to be coupled to the at least bearing section.

19 Claims, 5 Drawing Sheets

STEAM TURBINE ROTOR AND METHOD OF ASSEMBLING THE SAME

BACKGROUND OF THE INVENTION

The field of the invention relates generally to steam turbines, and more particularly to a rotor assembly for use with a steam turbine.

At least some known rotors are fabricated as a single forging that includes rotor coupling ends, bearing regions, packing regions, and a steampath section. Generally, the material used in fabricating such rotors is dictated by operational requirements and specifications in the higher temperature and higher pressure regions of the rotor. In at least some known rotors, a high performance steel, such as 12Cr steel, is used as a material in the high temperature and high pressure regions, as this type of material has an appropriate strength and creep capability for such operating conditions. However, manufacturing an entire rotor from such a steel material may be expensive and impractical.

At least some other known rotors are fabricated from multiple forgings that may include individually and separately manufactured rotor coupling ends, bearing regions, packing regions, and/or steampath sections. Multiple forgings enable different, more suitable and/or cost-effective materials to be used in each section of the rotor. Specifically, in steam turbine rotors in which individual components of the rotor are mechanically coupled together, materials for the rotors are generally selected based on anticipated steam conditions in the high pressure and low pressure regions. Lower grade steel, such as CrMoV steel, may be used to fabricate turbine rotor components located in the areas of lower temperatures and/or pressures. The components are then coupled together for operation. In some known rotors, the components are coupled together via a welding process.

BRIEF DESCRIPTION OF THE INVENTION

In one aspect, a steam turbine rotor is provided. The rotor includes at least one coupling section, at least one bearing section coupled axially to the at least one coupling section, and a steampath section comprising at least one end, said at least one end further comprising a flange and a bore, said flange and said bore configured to be coupled to the at least bearing section.

In another aspect, a turbine engine is provided. The engine includes a turbine and a rotor extending axially through said turbine, where the rotor includes at least one bearing section, at least one packing section coupled axially to the at least one bearing section, and a steampath section comprising at least one end, said at least one end further comprising a flange and a bore, said flange and said bore configured to be coupled to said the at least bearing section.

In yet another aspect, a method for assembling a turbine rotor is provided. The method includes fabricating a steampath section comprising at least one end such that a bore and a flange are defined in each end, fabricating at least one bearing section comprising a first end and an opposite second end, wherein fabricating each bearing section further comprises fabricating a substantially cylindrical rotor portion, extending an interference portion co-axially from the rotor portion and configuring said interference portion to be inserted into the steampath section bore extending a rim portion radially outward from the rotor portion and configuring said rim portion to provide an area for securing the packing section to the steampath section, coupling a bearing section to the at least one packing section first end, and coupling the steampath section to the at least one packing section.

DETAILED DESCRIPTION OF THE INVENTION

Figure 1:
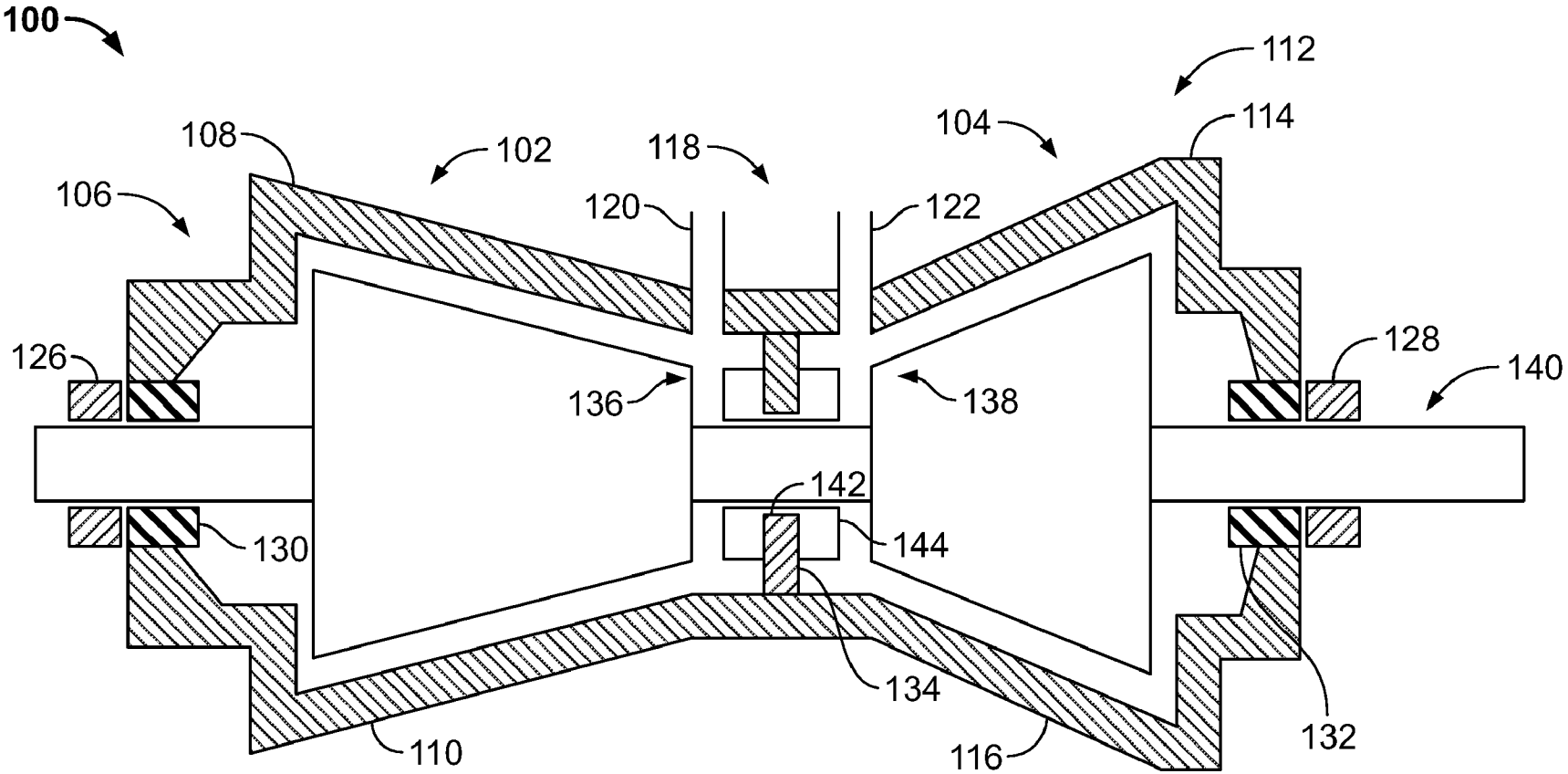
FIG. 1 is a cross-sectional schematic view of an exemplary opposed-flow steam turbine engine.

FIG. 1 is a cross-sectional schematic illustration of an exemplary opposed-flow steam turbine engine 100 including a high pressure (HP) section 102 and an intermediate pressure (IP) section 104. An HP shell, or casing, 106 is divided axially into upper and lower half sections 108 and 110, respectively. Similarly, an IP shell 112 is divided axially into upper and lower half sections 114 and 116, respectively. In the exemplary embodiment, shells 106 and 112 are inner casings. Alternatively, shells 106 and 112 are outer casings. A central section 118 positioned between HP section 102 and IP section 104 includes a high pressure steam inlet 120 and an intermediate pressure steam inlet 122. Within casings 106 and 112, HP section 102 and IP section 104, respectively, are arranged in a single bearing span supported by journal bearings 126 and 128. Steam seal apparatus 130 and 132 are located inboard of each journal bearing 126 and 128, respectively.

In the exemplary embodiment, an annular section divider 134 extends radially inwardly from central section 118 towards a rotor shaft 140 that extends between HP section 102 and IP section 104. More specifically, divider 134 extends circumferentially around a portion of rotor shaft 140 between a first HP stage inlet nozzle 136 and a first IP stage inlet nozzle 138. Divider 134 is received in a channel 142 defined in a packing casing 144. More specifically, channel 142 is a C-shaped channel that extends radially into packing casing 144 and around an outer circumference of packing casing 144, such that a center opening of channel 142 faces radially outwardly.

During operation, high pressure steam inlet 120 receives high pressure/high temperature steam from a steam source, for example, a fired boiler (not shown in FIG. 1). Steam is routed through HP section 102 from inlet nozzle 136 wherein work is extracted from the steam to rotate rotor shaft 140 via a plurality of turbine blades, or buckets (not shown in FIG. 1) that are coupled to shaft 140. Each set of buckets includes a corresponding stator assembly (not shown in FIG. 1) that facilitates routing of steam to the associated buckets. The steam exits HP section 102 and is returned to the boiler wherein it is reheated. Reheated steam is then routed to intermediate pressure steam inlet 122 and returned to IP section 104 via inlet nozzle 138 at a reduced pressure than steam entering HP section 102, but at a temperature that is approximately equal to the temperature of steam entering HP section 102. Work is extracted from the steam in IP section 104 in a manner substantially similar to that used for HP section 102 via a system of rotating and stationary components. Accordingly, an operating pressure within HP section 102 is higher than an operating pressure within IP section 104, such that steam within HP section 102 tends to flow towards IP section 104 through leakage paths that may develop between HP section 102 and IP section 104.

In the exemplary embodiment, steam turbine 100 is an opposed-flow high pressure and intermediate pressure steam turbine combination. Alternatively, steam turbine 100 may be used with any individual turbine including, but not being limited to, low pressure turbines. In addition, the present invention is not limited to being used with opposed-flow steam turbines, but rather may be used with steam turbine configurations that include, but are not limited to, single-flow and double-flow turbine steam turbines. Moreover, the present invention is not limited to steam turbines, but rather may be used with gas turbine engines.

Figure 2:
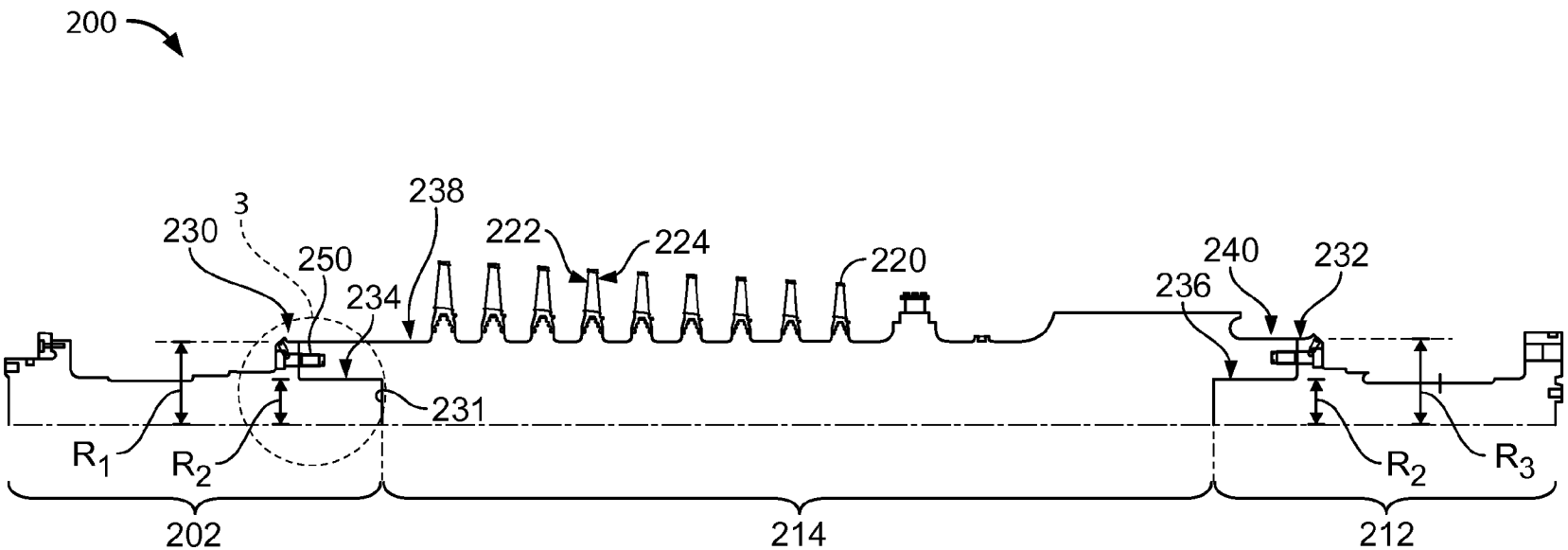
FIG. 2 is a schematic view of an exemplary rotor that used with the steam turbine shown in FIG. 1.
Figure 3:
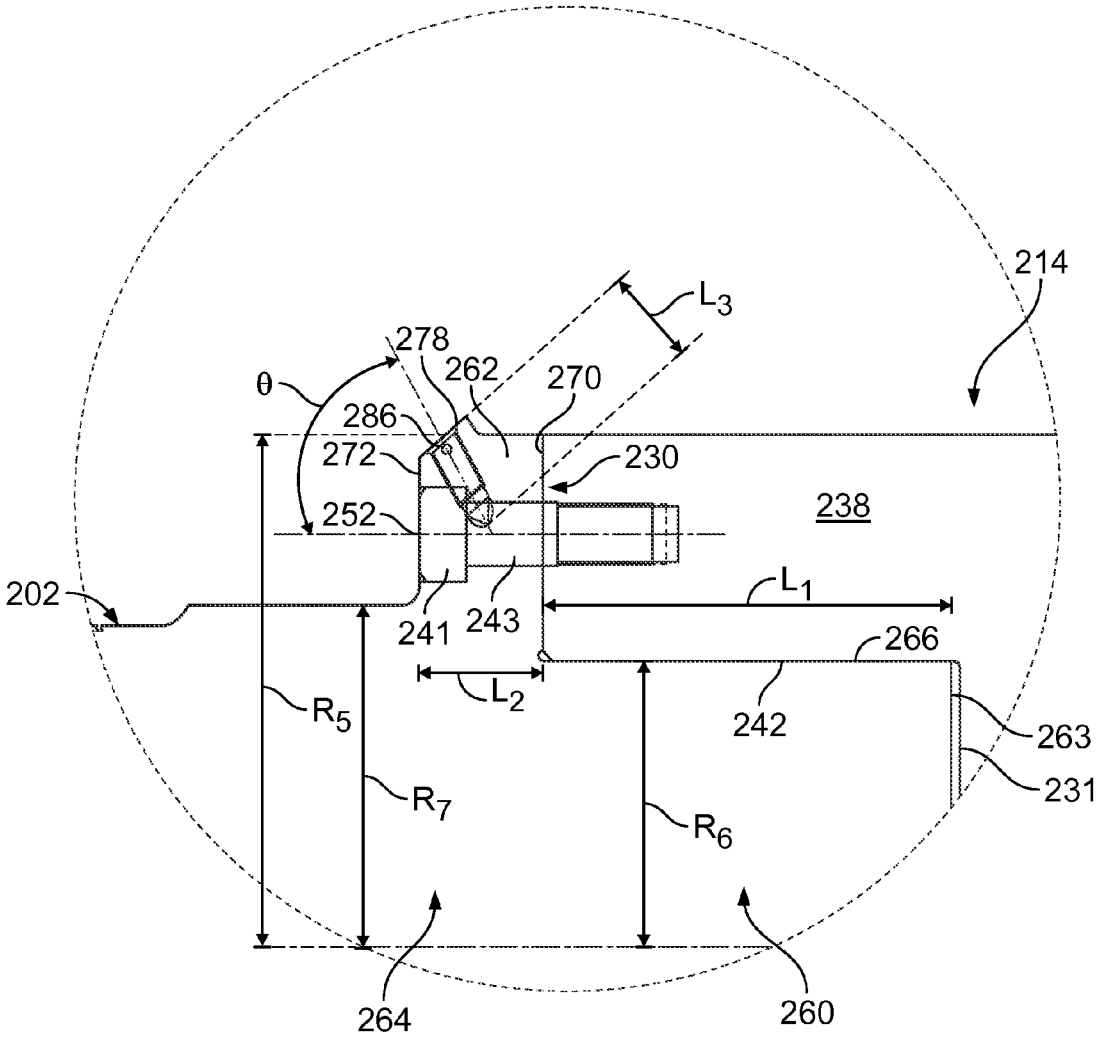
FIG. 3 is an enlarged schematic view of a portion of the rotor shown in FIG. 2.
Figure 4:
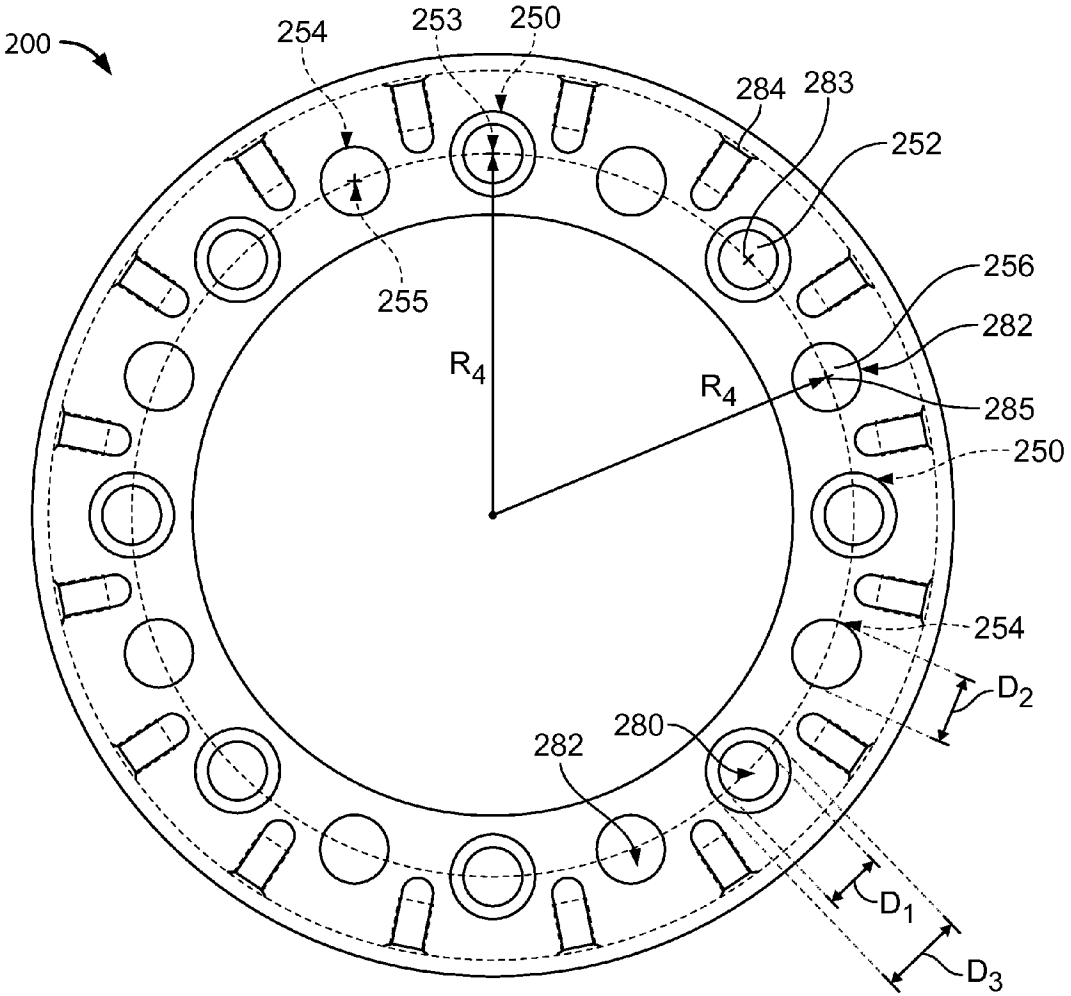
FIG. 4 is an enlarged end view of the rotor shown in FIG. 3.

FIG. 2 is a schematic view of an exemplary rotor 200 that may be used with steam turbine 100 (shown in FIG. 1). FIG. 3 is an enlarged schematic view of a portion of rotor 200, and FIG. 4 is an enlarged end view of rotor 200, shown in FIG. 3. Specifically, in the exemplary embodiment, rotor 200 forms a portion of rotor shaft 140 (shown in FIG. 1) that extends through turbine IP section 104. In the exemplary embodiment, a similar rotor portion (not shown) extends from rotor 200 through HP section 102. In an alternative embodiment, rotor 200 is independently used with a single-flow steam turbine. In another alternative embodiment, rotor 200 is used with a double-flow steam turbine. Rotor 200 includes a first bearing section 202 and a second bearing section 212. A steampath section 214 extends between bearing sections 202 and 212.

In the exemplary embodiment, steampath section 214 is coupled to first bearing section 202 and second bearing section 212 with an interference fit. Specifically, in the exemplary embodiment, steampath section 214 is coupled to bearing sections 202 and 212 by bolting and shrink fitting the sections together, as is described in more detail below. Steampath section 214 includes a plurality of wheels 220 that are machined from one integral piece. In the exemplary embodiment, wheels 220 are forged from a steel alloy or any other material suitable for use in a steam turbine. In the exemplary embodiment, nine wheels 220 are illustrated. In alternative embodiments, steampath section 214 may include any suitable number of wheels 220 that enables rotor 200 to function as described herein. Specifically, in the exemplary embodiment, each wheel 220 forms a stage of steampath section 214. In an alternative embodiment, each stage of steampath section 214 includes a group of wheels 220 that enables rotor 200 to function as described herein. In such an embodiment, each group of wheels 220 includes any suitable number of wheels 220 that enables rotor 200 to function as described herein. Moreover, in such an embodiment, each wheel 220 includes an upstream member 222 and a downstream member 224. Specifically, upstream member 222 includes a plurality of airfoils (not shown) and downstream member 224 is oriented such that a space is defined between the airfoils through which a stator assembly is positioned. In the exemplary embodiment, the downstream member 224 of each wheel 220 is coupled against an upstream member 222 of an adjacent wheel 220.

Steampath section 214 is formed with a first end 230 and an opposite second end 232. End 230 is formed with a bore 234 that is defined at least partially therein and that is sized to receive bearing section 202 therein. Similarly, end 232 is formed with a bore 236 defined at least partially therein that is sized to receive bearing section 212 therein. Moreover, each bore 234 and 236 is axially and substantially concentrically aligned with turbine 100. Each bore 234 and 236 has a length $L_1$ that extends from end 230 to an inner surface 231 and also is defined by a radial surface 242. In the exemplary embodiment, end 230 has a radius $R_1$, and bore 234 has a radius $R_2$ that is smaller than radius $R_1$ such that a flange 238 extends circumferentially about bore 234. Similarly, end 232 has a radius $R_3$ and bore 236 has a radius $R_2$ that is smaller than radius $R_3$ such that a flange 240 extends circumferentially about bore 236.

In the exemplary embodiment, each flange 238 and 240 includes a plurality of circumferentially-spaced openings 250 defined therein. Each opening 250 is defined within end 230 and 232, respectively, and has a diameter $D_1$ that is sized to receive a fastening mechanism 252 therein. Each opening 250 has a center 253 that is defined at a radius $R_4$ measured with respect to a rotational axis of turbine 100. In the exemplary embodiment, each fastening mechanism 252 is a bolt having a head portion 241 and a body portion 243 configured to couple bearing sections 202 and 212 to steampath section 214.

Each flange 238 and 240 also includes a plurality of circumferentially-spaced openings 254 defined therein. Each opening 254 is defined within end 230 and 232, respectively, and has a diameter $D_2$ that is sized to receive an alignment mechanism 256 therein. In the exemplary embodiment, each alignment mechanism 256 is a dowel that includes a first end (not shown) and an opposite second end (not shown) that facilitates the ease of assembly of rotor 200. Moreover, each opening 254 has a center 255 that is a defined at radius $R_4$ measured with respect to the rotational axis of turbine 100. In the exemplary embodiment, at least one opening 254 is defined between each pair of circumferentially-adjacent openings 250.

Bearing section 202 is coupled to steampath section 214. In the exemplary embodiment, first bearing section 202 is forged from a single piece of steel alloy or any other material that is suitable for use in a steam turbine. In an alternative embodiment, first bearing section 202 is forged of individual components and coupled together using any suitable coupling method such as, but not limited to, bolting, threading, welding, brazing, friction fitting, and/or shrink fitting.

In the exemplary embodiment, bearing section 202 is sized and shaped to be inserted into bore 234 of steampath section 214. Similarly, bearing section 212 is sized and shaped to be inserted into bore 236 of steampath section 214. Specifically, in the exemplary embodiment, each bearing section 202 and 212 includes an interference portion 260, a rim portion 262, and a rotor portion 264. Each interference portion 260 and bore 234 are coupled together with an interference fit (i.e., a friction fit) such that portion 260 is axially and substantially concentrically aligned with the rotational axis of turbine 100. Specifically, each interference portion 260 includes an outer surface 266 that mates with bore radial surface 242.

Each rim portion 262 extends between interference portion 260 and rotor portion 264 and has a radius $R_5$ that is larger than interference portion radius $R_6$. In the exemplary embodiment, radius $R_5$ is approximately equal to steampath section end 230 radius $R_1$. Specifically, each rim portion 262 is axially and substantially concentrically aligned with the rotational axis of turbine 100. Each rim portion 262 includes an upstream surface 270 and a downstream surface 272. A length $L_2$ is defined between surfaces 270 and 272. In the exemplary embodiment, length $L_2$ is shorter than interference portion length $L_1$. Each surface 270 contacts against steampath section end 230. Moreover, in the exemplary embodiment, each rim portion 262 includes a tapered surface 278.

In the exemplary embodiment, each rim portion 262 includes a plurality of circumferentially-spaced openings 280 defined therein. Each opening 280 extends between upstream and downstream surfaces 270 and 272, and each opening 280 has a center 283 defined at a radius $R_4$ with respect to the central rotational axis of turbine 100. In the exemplary embodiment, each opening 280 is counterbored such that opening 280 has a diameter $D_3$ and a through diameter $D_1$ that is smaller than diameter $D_3$. Each opening 280 is sized to receive at least one fastening mechanism 252 therein, such that each fastening mechanism 252 is inserted into each opening 280 through upstream surface 270 until the head portion 241 of each fastening mechanism 252 is substantially flush with downstream surface 272. During assembly of rotor 200, each opening 280 is substantially concentrically aligned with each opening 250 such that at least one fastening mechanism 252 may be inserted through at least one opening 250 and at least one opening 280 to couple sections 202 and 214 together.

Each rim portion 262 also includes a plurality of circumferentially-spaced openings 282 defined therein. Each opening 282 extends between upstream and downstream surfaces 270 and 272, and has a center 285 defined at radius R4 with respect to the rotational axis of turbine 100. In the exemplary embodiment, at least one opening 282 is defined between each pair of circumferentially-adjacent openings 280. In the exemplary embodiment, opening 282 has diameter D2 that is sized to receive at least one alignment mechanism 256 therein. During assembly, openings 282 are substantially concentrically aligned with openings 254 such that at least one alignment mechanism 256 may be inserted through at least one opening 282 and at least one opening 254 to facilitate aligning sections 202 and 214. Each alignment mechanism 256 is inserted into each opening 282 through upstream surface 270 until alignment mechanism second end (not shown) is substantially flush with downstream surface 272.

Each rim portion 262 also includes a plurality of circumferentially-spaced apertures 284 defined therein. Each aperture 284 is sized and oriented to receive at least one balance plug 286 therein. Each aperture 284 extends a length $L_3$ from surface 278 and is oriented at an angle θ with respect to the central rotational axis of turbine 100. Moreover, in the exemplary embodiment, each aperture 284 is positioned between at least one opening 280 and 282.

In the exemplary embodiment, interference portion 260 extends substantially co-axially from rotor portion 264 and is sized and oriented to be inserted into steampath section bores 234 and 236. Additionally, in the exemplary embodiment, rim portion 262 extends radially outward from rotor portion 264 and to provide an area for securing bearing section 202 to steampath section 214. Each rotor portion 264 extends from and couples to bearing sections 202 and 212, respectively. Specifically, in the exemplary embodiment, rotor portion 264 has a radius $R_7$ that is smaller than radius $R_1$ and larger than radius $R_2$.

During assembly of rotor 200, bearing sections 202 and 212 are coupled to respective ends (230 and 232) of steampath section 214 with an interference fit as shown in FIG. 3. At least one alignment mechanism 256 is at least partially inserted within at least one opening 254 to ease assembly and to facilitate aligning sections 202 and 212 with section 214. An interference portion 260 is inserted into bore 234 until rim portion upstream surface 270 is substantially adjacent to steampath section end 230 while, in the exemplary embodiment, surfaces 231 and 263 are not in contact. Similarly, interference portion 260 is inserted into bore 236 until rim portion upstream surface 270 is substantially adjacent to steampath section end 230, while surfaces 231 and 263 are not in contact with each other. Openings 250 are substantially concentrically aligned with openings 280, and openings 254 are axially aligned with openings 282 as interference portion 260 is inserted into bore 234. Subsequently, an alignment mechanism 256 is then inserted through opening 282 and into opening 254.

At least one fastening mechanism 252 is inserted into each opening 250 and 280. Specifically, body portion 243 is inserted through opening 250 and 280 until head portion 241 is substantially flush with downstream surface 272. Moreover, in the exemplary embodiment, a balance plug 286 is inserted within each aperture 284 to facilitate balancing rotor 200. Alternatively, any number of balance plugs 286 may be inserted within apertures 284 to enable rotor 200 to function as described herein.

Figure 5:
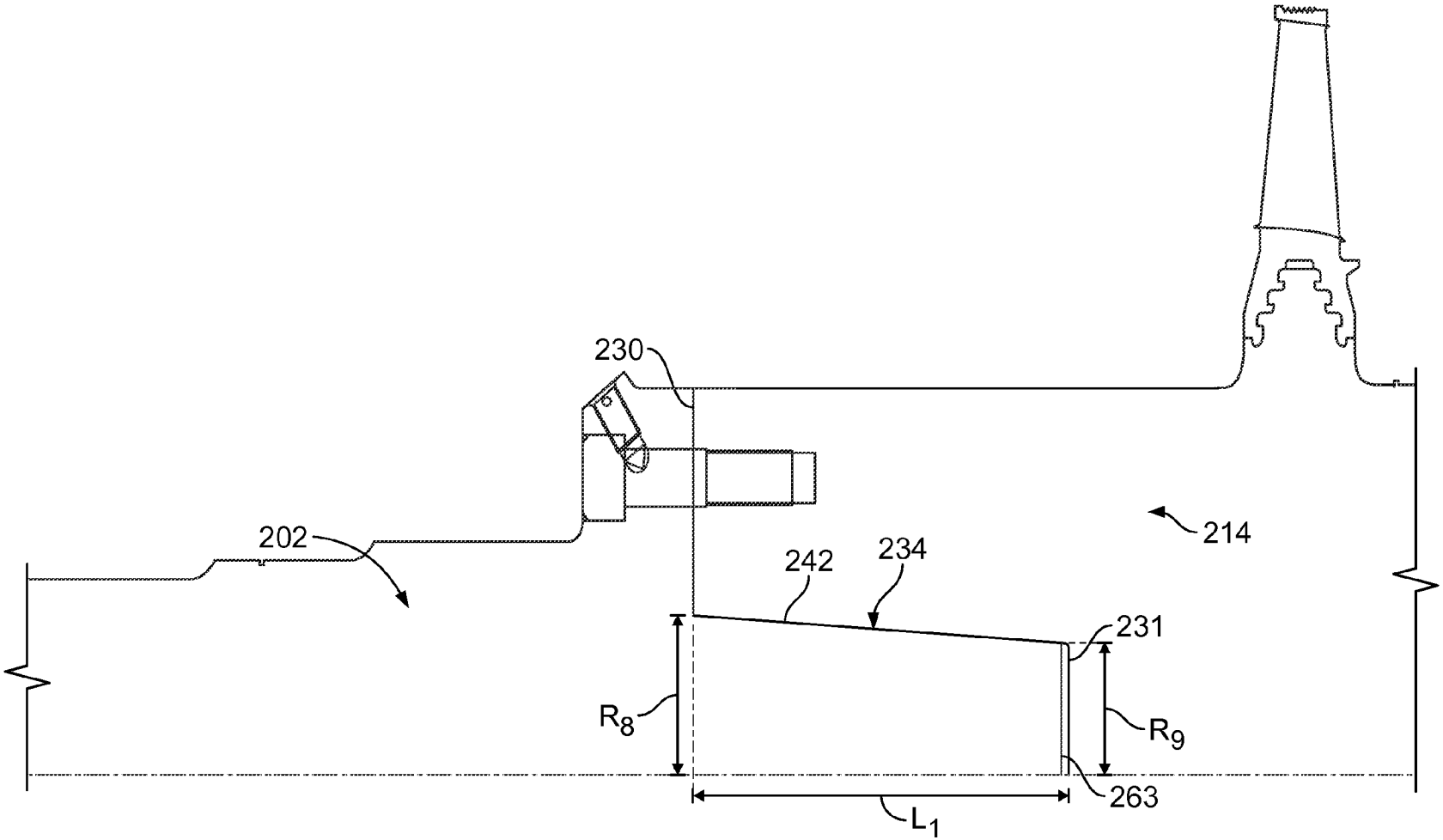
FIG. 5 is an enlarged schematic view of an alternative tapered interference fit.

Alternatively and as shown in FIG. 5, a tapered interference fit may be used to facilitate coupling bearing section 202 to steampath section 214. Steampath section 214 has a first end 230 and an opposite second end 232. End 230 includes a bore 234 defined therein that is sized to receive bearing section 202 therein. Similarly, end 232 includes a bore 236 defined therein that is sized to receive bearing section 212 therein. Moreover, each bore 234 and 236 is substantially concentrically aligned with the rotational axis of turbine 100. Each bore 234 and 236 has a length $L_1$ that extends from end 230 to surface 231, and also is defined by a radial surface 242. In the exemplary embodiment, end 230 has a radius $R_1$, and bore 234 has an outer radius $R_8$ that is smaller than radius $R_1$ such that a flange 238 extends circumferentially about bore 234. Similarly, end 232 has a radius $R_3$ and bore 236 has a radius $R_8$ that is smaller than radius $R_3$ such that a flange 240 extends circumferentially about bore 236. Additionally and in an alternative embodiment, each bore 234 and 236 has a decreasing radius along $L_1$ such that the bore surface 263 has a radius $R_9$ that is smaller than $R_8$. During assembly of rotor 200, bearing sections 202 and 212 are coupled to respective ends 230 and 232 of steampath section 214 with a tapered interference fit and fastened using, for example, the methods described herein.

Exemplary embodiments of steam turbine rotors are described in detail above. The above-described steam turbine rotors and methods of fabricating such rotors enable rotors to be fabricated from multiple forgings and multiple components that may include individually and separately manufactured rotor ends, bearing regions and steampath sections, while eliminating the need for weld inlays on such multiple forged rotors. Additionally, the methods described herein allow for less expense in fabricating rotor components that lie outside the high temperature and high pressure regions such that lower grade materials can be used in these regions.

As used herein, an element or step recited in the singular and proceeded with the word "a" or "an" should be understood as not excluding plural said elements or steps, unless such exclusion is explicitly recited. Furthermore, references to "one embodiment" of the present invention are not intended to be interpreted as excluding the existence of additional embodiments that also incorporate the recited features.

Although the apparatus and methods described herein are described in the context of fabricating a rotor for a steam turbine, it is understood that the apparatus and methods are not limited to rotors or steam turbines. Likewise, the rotor components illustrated are not limited to the specific embodiments described herein, but rather, components of rotor can be utilized independently and separately from other components described herein.

While the invention has been described in terms of various specific embodiments, those skilled in the art will recognize that the invention can be practiced with modification within the spirit and scope of the claims.

What is claimed is:

1. A steam turbine rotor comprising:

at least one bearing section comprising a rotor portion and an interference portion extending outwardly from said rotor portion, said interference portion comprising a radially outer surface; and a steampath section comprising a flange extending outwardly from at least one end, said flange comprising a radially inner surface defining a bore, said bore sized to receive said interference portion therein such that said interference portion outer surface is positioned adjacent to said flange inner surface to enable said at least one bearing section to couple to said steampath section, wherein the flange further comprises an annular end surface comprising a first plurality of circumferentially-spaced openings sized to receive a fastener that couples said bearing section to said steampath section, and a second plurality of circumferentially-spaced openings sized to receive an alignment mechanism for aligning said bearing section and said steampath section, centers of said first plurality of openings and said second plurality of openings being a substantially same radial distance from a central rotational axis of the rotor.

2. The steam turbine rotor in accordance with claim 1, wherein the at least one bearing section further comprises: a rim portion extending radially outwardly from the rotor portion, said rim portion configured to provide an area for fastening the at least one bearing section to the steampath section.

3. The steam turbine rotor in accordance with claim 2, wherein the rim portion further comprises:

a fastening system including said fastener configured to couple the at least one bearing section to the steampath section;

an alignment system including said alignment mechanism configured to ensure the rim portion is substantially axially and concentrically aligned with the central rotational axis of the rotor; and a balancing system configured to reduce vibration in the rotor.

4. The steam turbine rotor in accordance with claim 3, wherein the balancing system further comprises:

at least one balancing plug aperture spaced circumferentially around an outer surface of the rim portion; and at least one balancing plug.

5. The steam turbine rotor in accordance with claim 3, wherein the second plurality of openings comprise at least one alignment mechanism opening spaced circumferentially around an outer surface of the rim portion.

6. The steam turbine rotor in accordance with claim 5, wherein the at least one alignment mechanism is a dowel having a first end and an opposite second end configured to facilitate assembly of the rotor.

7. The steam turbine rotor in accordance with claim 3, wherein at least one of said first plurality of openings is spaced circumferentially around an outer surface of the rim portion and comprises a primary bore depth and a counterbore depth; and said fastener further comprises a head section and a body.

8. The steam turbine rotor in accordance with claim 7, wherein the fastener is a bolt having a head portion and a body portion configured to couple the at least one bearing section to the steam path section.

9. The steam turbine rotor in accordance with claim 1, wherein the interference portion is coupled to the steampath section with an interference fit.

10. The steam turbine rotor in accordance with claim 1, wherein the interference portion is coupled to the steampath section with a tapered interference fit.

11. A turbine engine comprising:

a turbine; and a rotor extending axially through said turbine, said rotor comprising:

at least one bearing section comprising a rotor portion and an interference portion extending outwardly from said rotor portion, said interference portion comprising a radially outer surface; and a steampath section comprising a flange extending outwardly from at least one end, said flange comprising a radially inner surface defining a bore, said bore sized to receive said interference portion therein such that said interference portion outer surface is positioned adjacent to said flange inner surface to enable said at least one bearing section to couple to said steampath section, wherein the flange further comprises an annular end surface comprising a first plurality of circumferentially-spaced openings sized to receive a fastener that couples said bearing section to said steampath section, and a second plurality of circumferentially-spaced openings sized to receive an alignment mechanism for aligning said bearing section and said steampath section, centers of said first plurality of openings and said second plurality of openings being a substantially same radial distance from a central rotational axis of the rotor.

12. The turbine engine in accordance with claim 11, wherein the at least one bearing section further comprises a rim portion extending radially outwardly from the rotor portion.

13. The turbine engine in accordance with claim 12, wherein the rim portion further comprises:

a plurality of fastening mechanisms including said fastener configured to couple the at least one bearing section to the steampath section;

a plurality of alignment mechanisms configured to ensure the rim portion is substantially axially and concentrically aligned with the central rotational axis of the rotor; and a plurality of balancing mechanisms configured to reduce vibration in the rotor.

14. The turbine engine in accordance with claim 11, wherein the interference portion is coupled to the steampath section with an interference fit.

15. The turbine engine in accordance with claim 11, wherein the interference portion is coupled to the steampath section with a tapered interference fit.

16. A method for assembling a turbine rotor, said method comprising:

fabricating a steampath section including a flange extending outwardly from at least one end, wherein the flange includes a radially inner surface that defines a bore therein, and an annular end surface comprising a first plurality of circumferentially-spaced openings sized to receive a fastener that couples said bearing section to said steampath section, and a second plurality of circumferentially-spaced openings sized to receive an alignment mechanism for aligning said bearing section and said steampath section, centers of said first plurality of openings and said second plurality of openings being a substantially same radial distance from a central rotational axis of the rotor;

fabricating at least one bearing section including a substantially cylindrical rotor portion, an interference portion extending outwardly from the rotor portion, and a rim portion extending radially outwardly from the rotor portion, the interference portion including a radially outer surface; and coupling the steampath section to the at least one bearing section such that the interference portion is inserted into the bore of the steampath section and such that the interference portion outer surface is adjacent to the flange inner surface.

17. The method in accordance with claim 16, wherein coupling the steampath section to the at least one bearing section further comprises coupling the steampath section to the at least one bearing section with an interference fit defined between the interference portion and the bore.

18. The method in accordance with claim 16, wherein coupling the steampath section to the at least one bearing section further comprises coupling the steampath section to the at least one bearing section with a tapered interference fit defined between the interference portion and the bore.

19. The method in accordance with claim 16, wherein fabricating the at least one bearing section further comprises including a plurality of alignment mechanisms, a plurality of fastening mechanisms including said fastener, and a plurality of balancing mechanisms.

* * * * *